US007470381B2

(12) United States Patent
Placek et al.

(10) Patent No.: US 7,470,381 B2
(45) Date of Patent: Dec. 30, 2008

(54) FUNCTIONAL FLUID AND THE USE THEREOF

(75) Inventors: Douglas G. Placek, Yardley, PA (US); Bernhard G. Kinker, Kintnersville, PA (US); David J. Cooper, Jr., Quakertown, PA (US); Robert P. Simko, Norristown, PA (US)

(73) Assignee: RohMax Additives GmbH, Darmstadt (DE)

( * ) Notice: Subject to any disclaimer, the term of this patent is extended or adjusted under 35 U.S.C. 154(b) by 161 days.

(21) Appl. No.: 10/626,645

(22) Filed: Jul. 25, 2003

(65) Prior Publication Data

US 2005/0023504 A1 Feb. 3, 2005

(51) Int. Cl.
*C09K 21/06* (2006.01)

(52) U.S. Cl. ..... 252/601; 252/71

(58) Field of Classification Search ..... 252/70, 252/71, 601

See application file for complete search history.

(56) References Cited

U.S. PATENT DOCUMENTS 3,243,455 A * 3/1966 Pizzini et al. ..... 562/110
3,311,597 A * 3/1967 Mottus ..... 526/270
3,518,917 A * 7/1970 Sluhan ..... 409/131
3,718,596 A * 2/1973 Richard, Jr. ..... 252/78.5
5,646,098 A * 7/1997 Brois ..... 508/189
5,696,066 A * 12/1997 Kinker et al. ..... 508/469
5,955,405 A * 9/1999 Liesen et al. ..... 508/469
6,323,164 B1 * 11/2001 Liesen et al. ..... 508/469
6,403,746 B1 * 6/2002 Roos et al. ..... 526/319
6,521,142 B1 * 2/2003 Holgado et al. ..... 252/78.5
2002/0123583 A1 * 9/2002 Gore et al. ..... 526/217
2003/0060587 A1 * 3/2003 Roos et al. ..... 526/319
2004/0092409 A1 * 5/2004 Liesen ..... 508/469

FOREIGN PATENT DOCUMENTS

JP 081209179 * 8/1996

* cited by examiner

*Primary Examiner*—Lorna M Douyon
*Assistant Examiner*—Amina Khan
(74) *Attorney, Agent, or Firm*—Oblon, Spivak, McClelland, Maier & Neustadt, P.C.

(57) ABSTRACT

The present invention concerns a functional fluid comprising A) 1 to 99% by weight based on the total weight of the functional fluid of alkyl(meth)acrylate polymers obtainable by polymerizing a mixture of olefinically unsaturated monomers and B) 1 to 99% by weight based on the total weight of the functional fluid of an oxygen containing compound selected from to group of organophosphorus compounds, carboxylic acid esters and/or polyether polyols.

24 Claims, No Drawings

FUNCTIONAL FLUID AND THE USE THEREOF

The present invention is directed to a functional fluid and the use thereof.

Functional fire resistant fluids are well known in the art. Such fluids can be used as hydraulic fluids. The current fire-resistant hydraulic market is dominated by four main classes of fluids;

HFA: High water content fluids, >80% water

HFB: Water-in-Oil emulsions. <50% water

HFC: Water/glycol fluids (30-80% water)

HFD: Anhydrous fluids

HFD-R: Phosphate ester fluids

HFD-U: All others, including polyol esters, vegetable esters, fluorocarbons, silicate esters, silanes, and certain PAO fluids.

A wide range of cost and performance options can be found within this class of fluids. Water/glycol systems are a widely used low cost fire-resistant fluid option, however, are limited to low pressure applications and invite corrosion and high maintenance. The temperature operating window is limited to −20 to 60° C. Vegetable oil and polyol ester systems are the lowest priced anhydrous systems available. The vegetable oil or vegetable derived fluids offer excellent biodegradability, however, these systems offer (relative) weak fire-resistance and poor oxidative stability, and often unacceptable low temperature performance. Temperature operating windows range from −10 to 100° C. Fully saturated synthetic polyol ester fluids offer good oxidative stability and a wide temperature operating window (−40 to 120° C.), however they provide relatively weak fire resistance (Factory Mutual Group 2 ratings by FMRC 6930). Many polyol ester and vegetable oil fluids employ the use of high molecular weight polymers for antimist control, and these additives are subject to shear degradation. Triaryl phosphates offer a high level of fire-resistance and applicability, but their benefits are offset by high cost, seal compatibility problems, and phenolic waste generation upon decomposition.

Typical to industrial hydraulic fire-resistant fluid technology is the use of fatty acid esters and phosphate esters with and without the use of polymeric additives. It was commonly known that the use of low molecular weight polymer additives proved inefficient towards improving fire-resistance properties until Hara, Shigeo, et.al. of Idemitsu Kosan Co., Ltd., (Japanese Patent Application No. 269480/1999, Idemitsu Kosan Co., Ltd.) demonstrated efficient fire-resistant property improvement from the use of a combination of high and low molecular weights in a polymer combination system. The inventors claim that the use of low molecular weight polymers alone are not effective.

The German Patent DE 1979-2948020, Mobil Oil Corp. describes that hydraulic fluids can be formulated from oleic acid esters of a polyol (Especially pentaerythritol, trimethylol propane, or neopentyl glycol). The claims indicate synergies between antioxidant and defoamer additives leading to extended fluid life. There are no claims regarding the use of polymer components. It is unlikely that these compositions could meet the requirements of the new Factory Mutual fire resistance tests, and low temperature performance would be poor.

Taking into consideration the prior art, it is an object of this invention to make available new functional fluids having an improved high fire resistance which do not invite corrosion. In addition, it is an object of the present invention to provide fire resistant functional fluids that have good low temperature properties. Furthermore, the new fluids are supposed to be produceable in a simple and cost favorable way. Moreover, it is an object of the present invention to provide fluids being biodegradable and environmentally friendly. Additionally, it is an object of the present invention to supply new functional fluids being applicable over a wide temperature range. Furthermore, the fluid should be appropriate for high pressure applications.

These as well as other not explicitly mentioned tasks, which, however, can easily be derived or developed from the introductory part, are solved by functional fluids of the present invention. Expedient modifications of the fluids in accordance with the invention are described in the claims.

A functional fluid comprising

A) 1 to 99% by weight based on the total weight of the functional fluid of alkyl(meth)acrylate polymers obtainable by polymerizing a mixture of olefinically unsaturated monomers, which consists of a) 1-100 wt % based on the total weight of the ethylenically unsaturated monomers of one or more ethylenically unsaturated ester compounds of formula (I)

(I)

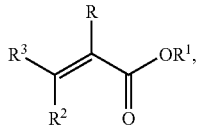

where R is hydrogen or methyl, $R^1$ means a linear or branched alkyl residue with 1-6 carbon atoms, $R^2$ and $R^3$ independently represent hydrogen or a group of the formula —COOR', where R' means hydrogen or a alkyl group with 1-6 carbon atoms, b) 0-99 wt % based on the total weight of the ethylenically unsaturated monomers of one or more ethylenically unsaturated ester compounds of formula (II)

(II)

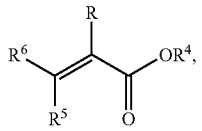

where R is hydrogen or methyl, $R^4$ means a linear or branched alkyl residue with 7-40 carbon atoms, $R^5$ and $R^6$ independently are hydrogen or a group of the formula —COOR", where R" means hydrogen or an alkyl group with 7-40 carbon atoms, c) 0-50 wt % based on the total weight of the ethylenically unsaturated monomers comonomers, and B) 1 to 99% by weight based on the total weight of the functional fluid of an oxygen containing compound selected from the group of organophosphorus compounds, carboxylic acid esters and/or polyether polyols provides a high fire resistance and can be applied over a wide temperature range.

At the same time a number of other advantages can be achieved through the functional fluids in accordance with the invention. Among these are:

The functional fluid of the present invention has favorable combustibility/flammability characteristics, The functional fluid of the present invention has an improved cost/performance ratio.

The functional fluid of the present invention is biodegradable and environmentally acceptable.

The functional fluid of the present invention shows an improved low temperature performance.

The functional fluid of the present invention can be produced on a cost favorable basis.

The functional fluid of the present invention exhibits good resistance to oxidation and is chemically very stable.

The viscosity of the functional fluid of the present invention can be adjusted over a broad range.

Furthermore, the fluids of the present invention are appropriate for high pressure applications. The functional fluids of the present invention show a low shear degradation.

The fluid of the present invention comprises 1 to 99% by weight, especially 2 to 50% by weight, and preferably 5 to 30% by weight, based on the total weight of the functional fluid, of one or more functional alkyl(meth)acrylate polymers.

The compositions from which the alkyl(meth)acrylate polymers are obtainable contain, in particular, (meth)acrylates, maleates and fumarates that have different alcohol residues. The term (meth)acrylates includes methacrylates and acrylates as well as mixtures of the two. These monomers are to a large extent known. The alkyl residue can be linear, cyclic or branched.

Mixtures to obtain the alkyl(meth)acrylate polymers contain 1 to 100 wt %, preferably 1 to 90 wt %, especially 10 to 80 wt %, more preferably 15 to 70 wt % based on the total weight of the monomer mixture of one or more ethylenically unsaturated ester compounds of formula (I)

(I)

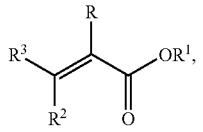

where R is hydrogen or methyl, $R^1$ means a linear or branched alkyl residue with 1-6, especially 1 to 5 and preferably 1 to 3 carbon atoms, $R^2$ and $R^3$ are independently hydrogen or a group of the formula —COOR', where R' means hydrogen or an alkyl group with 1-6 carbon atoms.

Examples of component (a) are, among others, (meth) acrylates, fumarates and maleates, which derived from saturated alcohols such as methyl (meth)acrylate, ethyl (meth) acrylate, n-propyl (meth)acrylate, isopropyl (meth)acrylate, n-butyl (meth)acrylate, tert-butyl (meth)acrylate, pentyl (meth)acrylate and hexyl (meth)acrylate; cycloalkyl (meth) acrylates, like cyclopentyl (meth)acrylate.

Furthermore, the monomer compositions to produce the polyalkyl(meth)acrylates useful in the present invention contain 0-99, preferably 10-99 wt %, especially 20-90 wt % and more preferably 30 to 85 wt % based on the total weight of the monomer mixture of one or more ethylenically unsaturated ester compounds of formula (II)

(II)

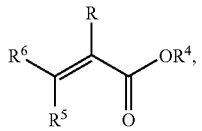

where R is hydrogen or methyl, $R^4$ means a linear or branched alkyl residue with 7-40, especially 10 to 30 and preferably 12 to 24 carbon atoms, $R^5$ and $R^6$ are independently hydrogen or a group of the formula —COOR", where R" means hydrogen or an alkyl group with 7 to 40, especially 10 to 30 and preferably 12 to 24 carbon atoms.

Among these are (meth)acrylates, fumarates and maleates that derive from saturated alcohols, such as 2-ethylhexyl (meth)acrylate, heptyl (meth)acrylate, 2-tert-butylheptyl (meth)acrylate, octyl (meth)acrylate, 3-isopropylheptyl (meth)acrylate, nonyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth)acrylate, eicosyl (meth)acrylate, cetyleicosyl (meth)acrylate, stearyleicosyl (meth)acrylate, docosyl (meth)acrylate, and/or eicosyltetratriacontyl (meth)acrylate;

cycloalkyl (meth)acrylates such as 3-vinylcyclohexyl (meth) acrylate, cyclohexyl (meth)acrylate, bornyl (meth)acrylate, 2,4,5-tri-t-butyl-3-vinylcyclohexyl (meth)acrylate, 2,3,4,5-tetra-t-butylcyclohexyl (meth)acrylate; and the corresponding fumarates and maleates.

The ester compounds with a long-chain alcohol residue, especially component (b), can be obtained, for example, by reacting (meth)acrylates fumarates, maleates and/or the corresponding acids with long chain fatty alcohols, where in general a mixture of esters such as (meth)acrylates with different long chain alcohol residues results. These fatty alcohols include, among others, Oxo Alcohol® 7911 and Oxo Alcohol® 7900, Oxo Alcohol® 1100 (Monsanto); Alphanol® 79 (ICI); Nafol® 1620, Alfol® 610 and Alfol® 810 (Condea); Epal® 610 and Epal® 810 (Ethyl Corporation); Linevol® 79, Linevol® 911 and Dobanol® 25L (Shell AG); Lial 125 (Augusta® Mailand); Dehydad® and Lorol®) (Henkel KGaA) and Linopol® 7-11 and Acropol® 91 (Ugine Kuhlmann).

Of the ethylenically unsaturated ester compounds, the (meth)acrylates are particularly preferred over the maleates and furmarates, i.e., $R^2$, $R^3$, $R^5$, $R^6$ of formulas (I) and (II) represent hydrogen in particularly preferred embodiments.

Component (c) comprises in particular ethylenically unsaturated monomers that can copolymerize with the ethylenically unsaturated ester compounds of formula (I) and/or (II).

Comonomers that correspond to the following formula are especially suitable for polymerization in accordance with the invention:

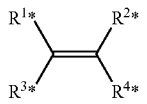

where $R^{1*}$ and $R^{2*}$ independently are selected from the group consisting of hydrogen, halogens, CN, linear or branched alkyl groups with 1-20, preferably 1-6 and especially preferably 1-4 carbon atoms, which can be substituted with 1 to (2n+1) halogen atoms, where n is the number of carbon atoms of the alkyl group (for example $CF_3$), α,β-unsaturated linear or branched alkenyl or alkynyl groups with 2-10, preferably 2-6 and especially preferably 2-4 carbon atoms, which can be substituted with 1 to (2n-1) halogen atoms, preferably chlorine, where n is the number of carbon atoms of the alkyl group, for example $CH_2{=}CCl{-}$, cycloalkyl groups with 3-8 carbon atoms, which can be substituted with 1 to (2n−1) halogen atoms, preferably chlorine, where n is the number of carbon atoms of the cycloalkyl group; $C({=}Y^*)R^{5*}$, $C({=}Y^*)NR^{6*}R^{7*}$, $Y^*C({=}Y^*)R^{5*}$, $SOR^{5*}$, $SO_2R^{5*}$, $OSO_2R^{5*}$, $NR^{8*}SO_2R^{5*}$, $PR^{5*}{}_2$, $P({=}Y^*)R^{5*}{}_2$, $Y^*PR^{5*}{}_2$, $Y^*P({=}Y^*)R^{5*}{}_2$, $NR^{8*}{}_2$, which can be quaternized with an additional $R^{8*}$, aryl, or heterocyclyl group, where Y* can be $NR^{8*}$, S or O, preferably O; $R^{5*}$ is an alkyl group with 1-20 carbon atoms, an alkylthio group with 1-20 carbon atoms, $OR^{15}$ ($R^{15}$ is hydrogen or an alkali metal), alkoxy with 1-20 carbon atoms, aryloxy or heterocyclyloxy; $R^6$ and $R^7$ independently are hydrogen or an alkyl group with one to 20 carbon atoms, or $R^{6*}$ and $R^{7*}$ together can form an alkylene group with 2-7, preferably 2-5 carbon atoms, where they form a 3-8 member, preferably 3-6 member ring, and $R^{8*}$ is linear or branched alkyl or aryl groups with 1-20 carbon atoms;

$R^{3*}$ and $R^{4*}$ independently are chosen from the group consisting of hydrogen, halogen (preferably fluorine or chlorine), alkyl groups with 1-6 carbon atoms and $COOR^{9*}$, where $R^{9*}$ is hydrogen, an alkali metal or an alkyl group with 1-40 carbon atoms, or $R^{1*}$ and $R^{3*}$ can together form a group of the formula $(CH_2)_n$, which can be substituted with 1-2n' halogen atoms or $C_1$-$C_4$ alkyl groups, or can form a group of the formula $C({=}O){-}Y^*{-}C({=}O)$, where n' is from 2-6, preferably 3 or 4, and Y* is defined as before;

and where at least 2 of the residues $R^{1*}$, $R^{2*}$, $R^{3*}$ and $R^{4*}$ are hydrogen or halogen.

These include, among others, hydroxyalkyl (meth)acrylates like 3-hydroxypropyl (meth)acrylate, 3,4-dihydroxybutyl (meth)acrylate, 2-hydroxyethyl (meth)acrylate, 2-hydroxypropyl (meth)acrylate, 2,5-dimethyl-1,6-hexanediol (meth) acrylate, 1,10-decanediol (meth)acrylate;

aminoalkyl (meth)acrylates and aminoalkyl (meth)acrylamides like N-(3-dimethylaminopropyl)methacrylamide, 3-diethylaminopentyl (meth)acrylate, 3-dibutylaminohexadecyl (meth)acrylate;

nitriles of (meth)acrylic acid and other nitrogen-containing (meth)acrylates like N-(methacryloyloxyethyl)diisobutylketimine, N-(methacryloyloxyethyl)dihexadecylketimine, (meth)acryloylamidoacetonitrile, 2-methacryloyloxyethylmethylcyanamide, cyanomethyl (meth) acrylate;

aryl (meth)acrylates like benzyl (meth)acrylate or phenyl (meth)acrylate, where the acryl residue in each case can be unsubstituted or substituted up to four times;

carbonyl-containing (meth)acrylates like 2-carboxyethyl (meth)acrylate, carboxymethyl (meth)acrylate, oxazolidinylethyl (meth)acrylate, N-methyacryloyloxy)formamide, acetonyl (meth)acrylate, N-methacryloylmorpholine, N-methacryloyl-2-pyrrolidinone, N-(2-methyacryloyloxyethyl)-2-pyrrolidinone, N-(3-methacryloyloxypropyl)-2-pyrrolidinone, N-(2-methyacryloyloxypentadecyl (-2-pyrrolidinone, N-(3-methacryloyloxyheptadecyl-2-pyrrolidinone;

(meth)acrylates of ether alcohols like tetrahydrofurfuryl (meth)acrylate, vinyloxyethoxyethyl (meth)acrylate, methoxyethoxyethyl (meth)acrylate, 1-butoxypropyl (meth)acrylate, 1-methyl-(2-vinyloxy)ethyl (meth)acrylate, cyclohexyloxymethyl (meth)acrylate, methoxymethoxyethyl (meth)acrylate, benzyloxymethyl (meth)acrylate, furfuryl (meth)acrylate, 2-butoxyethyl (meth)acrylate, 2-ethoxyethoxymethyl (meth)acrylate, 2-ethoxyethyl (meth)acrylate, ethoxylated (meth)acrylates, allyloxymethyl (meth)acrylate, 1-ethoxybutyl (meth)acrylate, methoxymethyl (meth)acrylate, 1-ethoxyethyl (meth)acrylate, ethoxymethyl-(meth)acrylate;

(meth)acrylates of halogenated alcohols like 2,3-dibromopropyl (meth)acrylate, 4-bromophenyl (meth)acrylate, 1,3-dichloro-2-propyl (meth)acrylate, 2-bromoethyl (meth)acrylate, 2-iodoethyl (meth)acrylate, chloromethyl (meth)acrylate;

oxiranyl (meth)acrylate like 2,3-epoxybutyl (meth)acrylate, 3,4-epoxybutyl (meth)acrylate, 10,11 epoxyundecyl (meth)acrylate, 2,3-epoxycyclohexyl (meth)acrylate, oxiranyl (meth)acrylates such as 10,11-epoxyhexadecyl (meth)acrylate, glycidyl (meth)acrylate;

phosphorus-, boron- and/or silicon-containing (meth)acrylates like 2-(dimethylphosphato)propyl (meth)acrylate, 2-(ethylphosphito)propyl (meth)acrylate, 2-dimethylphosphinomethyl (meth)acrylate, dimethylphosphonoethyl (meth)acrylate, diethylmethacryloyl phosphonate, dipropylmethacryloyl phosphate, 2-(dibutylphosphono) ethyl (meth)acrylate, 2,3-butylenemethacryloylethyl borate, methyldiethoxymethacryloylethoxysiliane, diethylphosphatoethyl (meth)acrylate;

sulfur-containing (meth)acrylates like ethylsulfinylethyl (meth)acrylate, 4-thiocyanatobutyl (meth)acrylate, ethylsulfonylethyl (meth)acrylate, thiocyanatomethyl (meth) acrylate, methylsulfinyimethyl (meth)acrylate, bis(methacryloyloxyethyl) sulfide;

heterocyclic (meth)acrylates like 2-(1-imidazolyl)ethyl (meth)acrylate, 2-(4-morpholinyl)ethyl (meth)acrylate and 1-(2-methacryloyloxyethyl)-2-pyrrolidone;

vinyl halides such as, for example, vinyl chloride, vinyl fluoride, vinylidene chloride and vinylidene fluoride;

vinyl esters like vinyl acetate;

vinyl monomers containing aromatic groups like styrene, substituted styrenes with an alkyl substituent in the side chain, such as α-methylstyrene and α-ethylstyrene, substituted styrenes with an alkyl substituent on the ring such as vinyltoluene and p-methylstyrene, halogenated styrenes such as monochlorostyrenes, dichlorostyrenes, tribromostyrenes and tetrabromostyrenes;

heterocyclic vinyl compounds like 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

maleic acid derivatives such as maleic anhydride, methylmaleic anhydride, maleinimide, methylmaleinimide;

fumaric acid and fumaric acid derivatives such as, for example, mono- and diesters of fumaric acid.

Monomers that have dispersing functionality can also be used as comonomers. These monomers are well known in the art and contain usually hetero atoms such as oxygen and/or nitrogen. For example the previously mentioned hydroxyalkyl (meth)acrylates, aminoalkyl (meth)acrylates and aminoalkyl (meth)acrylamides, (meth)acrylates of ether alcohols, heterocyclic (meth)acrylates and heterocyclic vinyl compounds are considered as dispersing comononers.

Especially preferred mixtures contain methyl methacrylate, lauryl methacrylate and/or stearyl methacrylate.

The components can be used individually or as mixtures.

The molecular weight of the alkyl(meth)acrylate polymers is not critical. Usually the alkyl(meth)acrylate-polymers have a molecular weight in the range of 300 to 1,000,000 g/mol, preferably in the range of range of 500 to 500,000 g/mol and especially preferably in the range of 800 to 300,000 g/mol, without any limitation intended by this. These values refer to the weight average molecular weight of the polydisperse polymers.

According to a special aspect of the present invention the alkyl(meth)acrylate polymers have a low molecular weight. Such polymers have a very good low temperature performance. According to that special aspect of the present invention, alkyl(meth)acrylate polymers preferably have a molecular weight in the range of 300 to 50,000 g/mol, especially 500 to 30,000 g/mol and more preferably 1,000 to 10,000 g/mol.

Without intending any limitation by this, the alkyl(meth) acrylate polymers exhibit a polydispersity, given by the ratio of the weight average molecular weight to the number average molecular weight $M_w/M_n$, in the range of 1 to 15, preferably 1.1 to 10, especially preferably 1.2 to 5.

The monomer mixtures described above can be polymerized by any known method. Conventional radical initiators can be used to perform a classic radical polymerization. These initiators are well known in the art. Examples for these radical initiators are azo initiators like 2,2'-azodiisobutyronitrile (AIBN), 2,2'-azobis(2-methylbutyronitrile) and 1,1-azobiscyclohexane carbonitrile; peroxide compounds, e.g. methyl ethyl ketone peroxide, acetyl acetone peroxide, dilauryl peroxide, tert.-butyl per-2-ethyl hexanoate, ketone peroxide, methyl isobutyl ketone peroxide, cyclohexanone peroxide, dibenzoyl peroxide, tert.-butyl perbenzoate, tert.-butyl peroxy isopropyl carbonate, 2,5-bis(2-ethylhexanoyl-peroxy)-2,5-dimethyl hexane, tert.-butyl peroxy 2-ethyl hexanoate, tert.-butyl peroxy-3,5,5-trimethyl hexanoate, dicumene peroxide, 1,1-bis(tert.-butyl peroxy) cyclohexane, 1,1-bis(tert.-butyl peroxy) 3,3,5-trimethyl cyclohexane, cumene hydroperoxide and tert.-butyl hydroperoxide.

Low molecular weight poly(meth)acrylates can be obtained by using chain transfer agents. This technology is ubiquitously known and practiced in the polymer industry and is described in Odian, Principles of Polymerization, 1991. Examples of chain transfer agents are sulfur containing compounds such as thiols, e.g. n- and t-dodecanethiol, 2-mercaptoethanol, and mercapto carboxylic acid esters, e.g. methyl-3-mercaptopropionate. Preferred chain transfer agents contain up to 20, especially up to 15 and more preferably up to 12 carbon atoms. Furthermore, chain transfer agents may contain at least 1, especially at least 2 oxygen atoms.

Furthermore, the low molecular weight poly(meth)acrylates can be obtained by using transition metal complexes, such as low spin cobalt complexes. These technologies are well known and for example described in USSR patent 940, 487-A and by Heuts, et al., Macromolecules 1999, pp 2511-2519 and 3907-3912.

Furthermore, novel polymerization techniques such as ATRP (Atom Transfer Radical Polymerization) and or RAFT (Reversible Addition Fragmentation Chain Transfer) can be applied to obtain useful poly(meth)acrylates. These methods are well known. The ATRP reaction method is described, for example, by J-S. Wang, et al., J. Am. Chem. Soc., Vol. 117, pp. 5614-5615 (1995), and by Matyjaszewski, Macromolecules, Vol. 28, pp. 7901-7910 (1995). Moreover, the patent applications WO 96/30421, WO 97/47661, WO 97/18247, WO 98/40415 and WO 99/10387 disclose variations of the ATRP explained above to which reference is expressly made for purposes of the disclosure. The RAFT method is extensively presented in WO 98/01478, for example, to which reference is expressly made for purposes of the disclosure.

The polymerization can be carried out at normal pressure, reduced pressure or elevated pressure. The polymerization temperature is also not critical. However, in general it lies in the range of −20-200° C., preferably 0-130° C. and especially preferably 60-120° C., without any limitation intended by this.

The polymerization can be carried out with or without solvents. The term solvent is to be broadly understood here.

The fluid of the present invention comprises 1 to 99%, preferably by weight, especially 50 to 98% by weight, and preferably 70 to 95% by weight based on the total weight of the fluid one or more oxygen containing compounds selected from carboxylic acid esters, polyether polyols and phosphate esters, The esters and ethers according to component B) are different from the polyalkyl(meth)acrylates according to component A).

The oxygen containing compound according to component B) usually have a high fire point and a low viscosity at 40° C. According to a particular aspect of the present invention, the oxygen containing compound has a fire point according to ASTM D 92 of at least 250° C., preferably at least 280° C. and more preferably at least 300° C. The kinematic viscosity at 40° C. by ASTM D 445 of preferred oxygen containing compound useful as component B) is 40 $mm^2/s$ or less, especially 35 $mm^2/s$ or less and more preferably 30 $mm^2/s$ or less.

Compounds useful as component B) are well known in the art. Examples are organophosphorus compounds, carboxylic acid esters and polyether polyols.

The functional fluid of the present invention may comprise organophosphorus compounds. The primary class of compounds suitable for use are phosphorus ester fluids such as alkyl aryl phosphate ester; trialkyl phosphates such as tributyl phosphate or tri-2-ethyihexyl phosphate; triaryl phosphates such as mixed isopropyiphenyl phosphates, mixed t-butylphenyl phosphates, trixylenyl phosphate, or tricresylphosphate. Additional classes of organophosphorus compounds are phosphonates and phosphinates, which may contain alkyl and/or aryl substituents. Dialkyl phosphonates such as di-2-ethylhexylphosphonate; alkyl phosphinates such as di-2-ethylhexylphosphinate are possible. As the alkyl group herein, linear or branched chain alkyls consisting of 1 to 10 carbon atoms are preferred. As the aryl group herein, aryls consisting of 6 to 10 carbon atoms that maybe substituted by alkyls are preferred. Usually the functional fluids contain 0 to 60% by weight, preferably 5 to 50% by weight organophosphoms compounds.

As the carboxylic acid esters reaction products of alcohols such as polyhydric alcohol, monohydric alcohol and the like, and fatty acids such as mono carboxylic acid, poly carboxylic acid and the like can be used. Such carboxylic acid esters can of course be a partial ester.

Carboxylic acid esters may have one carboxylic ester group having the formula R—COO—R, wherein R is independently a group comprising 1 to 40 carbon atoms. Preferred ester compounds comprise at least two ester groups. These compounds may be based on poly carboxylic acids having at least two acidic groups and/or polyols having at least two hydroxyl groups.

The poly carboxylic acid residue usually has 2 to 40, preferably 4 to 24, especially 4 to 12 carbon atoms. Useful polycarboxylic acids esters are, e.g., esters of adipic, azelaic, sebacic, phthalate and/or dodecanoic acids. The alcohol component of the polycarboxylic acid compound preferably comprises 1 to 20, especially 2 to 10 carbon atoms.

Examples of useful alcohols are methanol, ethanol, propanol, butanol, pentanol, hexanol, heptanol and octanol. Furthermore, oxoalcohols can be used such as diethylene glycol, triethylene glycol, tetraethylene glycol up to decamethylene glycol.

Especially preferred compounds are esters of polycarboxylic acids with alcohols comprising one hydroxyl group. Examples of these compounds are described in Ullmanns Encyclopadie der Technischen Chemie, third edition, vol. 15, page 287-292, Urban & Schwarzenber (1964)).

Useful polyols to obtain ester compounds comprising at least two ester groups contain usually 2 to 40, preferably 4 to 22 carbon atoms. Examples are neopentyl glycol, diethylene glycol, dipropylene glycol, 2,2-dimethyl-3-hydroxypropyl-2',2'-dimethyl-3'-hydroxy propionate, glycerol, trimethylolethane, trimethanol propane, trimethylolnonane, ditrimethylolpropane, pentaerythritol, sorbitol, mannitol and dipentaerythritol. The carboxylic acid component of the polyester may contain 1 to 40, preferably 2 to 24 carbon atoms. Examples are linear or branched saturated fatty acids such as formic acid, acetic acid, propionic acid, octanoic acid, caproic acid, enanthic acid, caprylic acid, pelargonic acid, capric acid, undecanoic acid, lauric acid, tridecanoic acid, myrisric acid, pentadecanoic acid, palmitic acid, heptadecanoic acid, stearic acid, nonadecanoic acid, arachic acid, behenic acid, isomyiristic acid, isopalmitic acid, isostearic acid, 2,2-dimethylbutanoic acid, 2,2-dimethylpentanoic acid, 2,2-dimethyloctanoic acid, 2-ethyl-2.3,3-trimethylbutanoic acid, 2,2,3,4-tetramethylpentanoic acid, 2,5,5-trimethyl-2-t-butylhexanoic acid, 2,3,3-trimethyl-2-ethylbutanoic acid, 2,3-dimethyl-2-isopropylbutanoic acid, 2-ethylhexanoic acid, 3,5,5-trimethylhexanoic, acid; linear or branched unsaturated fatty such as linoleic acid, linolenic acid, 9-octadecenoic acid, undecenoic acid, elaidic acid, cetoleic acid, erucic acid, brassidic acid, and commercial grades of oleic acid from a variety of animal fat or vegetable oil sources. Mixtures of fatty acids such as tall oil fatty acids can be used.

Especially useful compounds comprising at least two ester groups are, e.g., Neopentyl Glycol tallate, Neopentyl Glycol dioleate, Propylene Glycol tallate, Propylene Glycol dioleate, Diethylene Glycol tallate, and Diethylene Glycol dioleate.

Many of these compounds are commercially available from Inolex Chemical Co. under the trademark Lexolube 2G-214, from Cognis Corp. under the trademark ProEco 2965, from Uniqema Corp. under the trademarks Priolube 1430 and Priolube 1446 and from Georgia Pacific under the trademarks Xtolube 1301 and Xtolube 1320.

Furthermore, ethers are useful as oxygen containing compounds according to component B) of the inventive fluid. Preferably, polyether polyols are used as component B) These compounds are well known. Examples are polyalkylene glycols like, e.g., polyethylene glycols, polypropylene glycols and polybutylene glycols. The polyalkylene glycols can be based on mixtures of alkylene oxides. These compounds preferably comprise 1 to 40 alkylene oxide units, more preferably 5 to 30 alkylene oxide units. Polybutylene glycols are preferred compounds for anhydrous fluids. The polyether polyols may comprise further groups, like e.g., alkylene or arylene groups comprising 1 to 40, especially 2 to 22 carbon atoms.

An especially useful polyether polyols is butylene oxide monobutylether.

Although the functional fluid of the present invention may contain compounds based on phenolics, alkyl hydrocarbons are preferred. According to a special aspect of the present invention, the functional fluid contain 25% by weight or less, preferably 15% by weight or less phenolic compounds based on the total of the fluid. Phenolic compounds contain an aromatic residue having at least one hydroxyl group.

Functional fluids of the present invention may contain a low amount of halogens. These halogens may be part of the alkyl(meth)acrylate according to component A) or of the oxygen containing compound according to component B). Preferably the fluids according to the present invention comprise 0.5% by weight or less, especially 0.1% by weight or less halogens such as chlorine or bromine based on the total of the fluid. More preferably the fluids of the present invention do not comprise any essential amounts of halogens.

Preferably, the functional fluids of the present invention are anhydrous fluids. According to a special aspect of the present invention, the functional fluid contain 5% by weight or less, preferably 2% by weight or less water based on the total of the fluid.

The carboxylic acid esters or the polyether polyols may be used as single compounds or as a mixture of two or more.

Preferably, the weight ratio of the alkyl(meth)acrylate polymers to the oxygen containing compound is in the range of 10:1 to 1:20, especially 5:1 to 1:15 and more preferably 2:1 to 1:10.

The functional fluid of the present invention may comprise further additives well known in the art such as viscosity index improvers, antioxidants, anti-wear agents, corrosion inhibitors, detergents, dispersants, EP additives, defoamers, friction reducing agents, pour point depressants, dyes, odorants and/or demulsifiers. These additives are used in conventional amounts. Usually the functional fluids contain 0 to 10% by weight additives.

The functional fluid of the present invention provides fire resistance and is considered to be "less hazardous" than standard mineral oil functional fluids. The fire resistance can be evaluated by the Factory Mutual standard FMRC 6930. Preferred fluids according to the present invention achieve a Group 1 rating.

According to the consumer needs, the viscosity of the functional fluid of the present invention can be adapted with in wide range. ISO VG 32, 46, 68, 100 fluid grades can be achieved, e.g.

| ISO 3448 Viscosity Grades | Typical Viscosity, cSt @ 40° C. | Minimum Viscosity, cSt @ 40° C. | Maximum Viscosity, cSt @ 40° C. |
|---|---|---|---|
| ISO VG 32 | 32.0 | 28.8 | 35.2 |
| ISO VG 46 | 46.0 | 41.4 | 50.6 |
| ISO VG 68 | 68.0 | 61.2 | 74.8 |
| ISO VG 100 | 100.0 | 90.0 | 110.0 |

Preferably the kinematic viscosity 40° C. according to ASTM D 445 of is the range of 15 $mm^2/s$ to 150 $mm^2/s$, preferably 28 $mm^2/s$ to 110 $mm^2/s$. The functional fluid of the present invention has a high viscosity index. Preferably the viscosity index according to ASTM D 2270 is at least 150, especially at least 180 and more preferably at least 200.

The functional fluid of the present invention has good low temperature performance. The low temperature performance can be evaluated by the Brookfield viscometer according to ASTM D 2983.

The functional fluid of the present invention can be used for high pressure applications. Preferred embodiments can be used at pressures between 0 to 700 bar, and specifically between 70 and 400 bar.

Furthermore, preferred functional fluids of the present invention have a low pour point, which can be determined, for example, in accordance with ASTM D 97. Preferred fluids have a pour point of −30° C. or less, especially −40° C. or less and more preferably −45° C. or less.

The functional fluid of the present invention can be used over a wide temperature range, For example the fluid can be used in a window of −40° C. to 120° C.

Furthermore, preferred functional fluids of the present invention have a high fire point according to ASTM D 92 of at least 280° C., preferably 300° C. and more preferably 320° C.

The functional fluid has a high biodegradability according to CEC L-33-A94 or OECD 301B. Preferred fluids show greater than 60% degradation, or conversion to $CO_2$.

The fire resistant functional fluids of the present invention are useful e.g. in industrial, automotive, mining, power generation, marine and military hydraulic fluid applications. Typical operations requiring the use of fire resistant fluids in stationary operations include metal foundries, metal processing, coal mining, and food processing plants. Mobile equipment applications include construction, forestry, delivery vehicles and municipal fleets (trash collection, snow plows, etc.). Marine applications include ship deck cranes.

The fire resistant functional fluids of the present invention are useful in power generation hydraulic equipment such as electrohydraulic turbine control systems.

Typical operations requiring the use of fire resistant fluids include aircraft hydraulics, catapult launch systems, ship elevators, tanks, and ground transport equipment.

Furthermore, the fire resistant functional fluids of the present invention are useful as transformer liquids or quench oils.

The invention is illustrated in more detail below by examples and comparison examples, without intending to limit the invention to these examples.

PREPARATION EXAMPLE 1

200 g 9-octadecenoic acid ester with 2,2-dimethyl-1,3-propanediol solvent (®Lexolube 2G-214 commercially available from Inolex Chemical Co.), 150 g LMA (LMA: lauryl methacrylate, mixture of long-chain methacrylates obtained from the reaction of methyl methacrylate with ®Lorol (Henkel KGaA)), 183 g methylmethacrylate, 10 g of 1-dodecanethiol (Aldrich 98+%) and 0.66 g 2,2'-azobis[2-methylbutyronitrile] (Vazo 67 commercially available from DuPont) was mixed in a three liter, inert gas purged, four neck, round bottom flask. Then the reaction mixture was heated to 95° C. with stirring under inert gas purge. Thereafter, a composition containing 300 g LMA, 367 g methylmethacrylate, 20 g of 1-dodecanethiol and 1.33 g 2,2'-azobis[2-methylbutyronitrile] was added over a time of 90 minutes. After completing the addition, 1.5 g 2,2'-azobis[2-methylbutyronitrile] dissolved in 2,6-dimethyl-4-heptanone, mixed with 400 g 9-octadecenoic acid ester with 2,2-dimethyl-1,3-propanediol solvent was added at a constant rate over 90 minutes. At the end of the feed, the mixture was stirred for another 20 minutes at 95° C.

Final product solids are 50% (theoretical, based on the monomer feed) with a Mw/Mn of $8.89\times10^3/7.41\times10^3$ (as characterized by a poly(methyl) methacrylate standardized GPC).

EXAMPLE 2

A low molecular weight polymer synthesized from 100% BMA (butyl methacrylate) without solvent dilution. The final product polymer solids are >99% with a weight average molecular weight (Mw) of $2.3\times10^3$.

EXAMPLES 3 TO 10 AND CONTROLS 1 TO 3

Compositions according to the table 1 are mixed using the polymers obtained in Preparation Example 1 and/or Example 2, Triaryl Phosphate Esters available from Great Lakes Chemical Corp. (Durad 300), Neopentyl Glycol Dioleate available from Inolex Chemical Co. (Lexolube 2G-214), Neopentyl Glycol tallate available from Georgia Pacific (Xtolube 1301), Diethylene Glycol tallate available from Georgia Pacific (Xtolube 1320), Propylene Glycol dioleate available from Uniqema (Priolube 1430).

The amount of the components are given in % by weight based on the total fluid.

The compositions were evaluated according to a ranking system for fire-resistant fluids provided by Factory Mutual. This system is based upon determination of a fluid's chemical heat release rate from combustion of an atomized spray, as well as the fluid's critical heat flux for ignition (the maximum heat flux at or below which there is no ignition)—as described by *Factory Mutual's Approval Standard for Flammability Classification of Industrial Fluids*—6390. This data is calculated into what Is called a Spray Flammability Parameter—a measure of the degree of flammability of a fluid in a highly atomized condition when pressurized—based on the following formula:

$$SFP=11.02\times10^2\times Q_{ch}/(\square_f q_{cr} m_f)$$

where:

$Q_{ch}$ is the chemical heat release rate determined in kW $q_{cr}$ is the critical heat flux for ignition in $kW/m^2$ $\square_f$ is the density of the fluid in $kg/m^3$ $m_f$ is the fluid mass flow rate during the chemical heat release in g/s—Divisor used to "normalize" SFP for comparison between apparatuses that have different flow dynamics. Therefore all SFP ratings are normalized at a measured unit of flow.

| These ratings are tiered as follows: | |
|---|---|
| Rating: | Comments & SFP: |
| Group 0 | Non flammable |
| Group 1 | Typically unable to support a spray flame. Normalized SFP =/< 5 |
| Group 2 | Can stabilize a spray flame under certain conditions - generally less flammable than mineral oil fluids. Normalized SFP > 5 but < 10 |

The SFP rating and the SFP value of the mixtures are given in Table 1. The fire point was determined according to ASTM D 92. The pour point was measured according to ASTM D 97. The kinematic viscosity was measured using the ASTM D 445 standard. Further evaluation methods and the results thereof are described in table 1.

TABLE 1

| Component | Example 3 | Example 4 | Reference 1 | Reference 2 | Reference 3 |
|---|---|---|---|---|---|
| Example 1 PAMA | 20.3% | 20.3% | | | |
| Neopentyl Glycol Dioleate | 79.7% | 59.7% | | 100% | |
| Triaryl Phosphate Ester | | 20% | | | 100% |
| Mineral Oil | | | 100% | | |
| ISO 3448 Viscosity Grade | VG 46 | VG 46 | VG 46 | VG 22 | VG 46 |
| Viscosity @ 40° C., $mm^2/s$ | 46.96 | 50.6 | 46 | 24.8 | 46 |
| Viscosity @ 100° C., $mm^2/s$ | 10.10 | 9.81 | 6.72 | 6.02 | |
| Viscosity index | 210 | 185 | 100 | 205 | |
| Readily Biodegradable by CEC L-33-A94 | YES | NO | NO | YES | NO |
| Pour Point, ° C. | −54 | | | −27 | −20 |
| Fire Point, ° C. | 320 | 320 | 252 | 320 | 350 |
| FMRC 693O SFP value | 3 | 3 | 11 | 5 | 3 |
| FMRC 6930 rating | Group 1 | Group 1 | Group 3 | Group 1 | Group 1 |
| Shear Stability, PSSI by ASTM D 5621 | <1 | <1 | 0 | 0 | 0 |

| Component | Example 5 | Example 6 | Example 7 | Example 8 | Example 9 |
|---|---|---|---|---|---|
| Example 1 PAMA | 30% | 45% | 20% | 22% | 22% |
| Neopentyl Glycol Dioleate | 70% | 55% | | | |
| Neopentyl Glycol tallate | | | 80% | | |
| Diethylene Glycol tallate | | | | 78% | |
| Propylene Glycol dioleate | | | | | 78% |
| ISO 3448 Viscosity Grade | VG 68 | VG 100 | VG 46 | VG 46 | VG 46 |
| Viscosity @ 40° C., $mm^2/s$ | 67.8 | ~100 | 46 | 46 | 46 |
| Readily | YES | YES | YES | YES | YES |

TABLE 1-continued

| | | | | | |
|---|---|---|---|---|---|
| Biodegradable by CEC L-33-A94 | | | | | |
| Pour Point, ° C. | −51 | −51 | −54 | | |
| Fire Point, ° C. | 320 | 320 | 320 | 320 | 320 |

| Component | Example 10 |
|---|---|
| Example 1 PAMA | 0% |
| Example 2 PAMA | 42% |
| Neopentyl Glycol Dioleate | 58% |
| Viscosity @ 40° C., $mm^2/s$ | ~46 |
| Viscosity @ 100° C., $mm^2/s$ | |
| Viscosity index | |
| Readily Biodegradable by CEC L-33-A94 | |
| FMRC 6930 SFP value | |
| FMRC 6930 rating | |
| Shear Stability, PSSI by ASTM D 5621 | <1 |

The invention claimed is:

1. A functional fluid comprising

A) 5 to 30% by weight based on the total weight of the functional fluid of one or more alkyl(meth)acrylate polymers obtainable by polymerizing a mixture of olefinically unsaturated monomers, which comprises a) 15-70 wt % based on the total weight of the ethylenically unsaturated monomers of one or more ethylenically unsaturated ester compounds of formula (I)

(I)

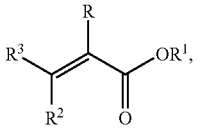

where R is hydrogen or methyl, $R^1$ means a linear or branched alkyl residue with 1-6 carbon atoms, $R^2$ and $R^3$ independently represent hydrogen or a group of the formula —COOR', where R' means hydrogen or an alkyl group with 1-6 carbon atoms, b) 30-85 wt % based on the total weight of the ethylenically unsaturated monomers of one or more ethylenically unsaturated ester compounds of formula (II)

(II)

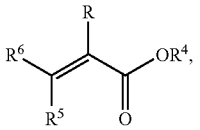

where R is hydrogen or methyl, $R^4$ means a linear or branched alkyl residue with 7-40 carbon atoms, $R^5$ and $R^6$ independently are hydrogen or a group of the formula —COOR", where R" means hydrogen or an alkyl group with 7-40 carbon atoms, and c) 0-50 wt % based on the total weight of the ethylenically unsaturated monomers of one or more comonomers, and B) 70 to 95% by weight based on the total weight of the functional fluid of at least one oxygen containing compound selected from the group consisting of neopentyl glycol dioleate, neopentyl glycol tallate, diethylene glycol dioleate, diethylene glycol tallate, propylene glycol tallate, trimethylol propane dioleate, pentaerythritol oleate, pentaerythritol dioleate and propylene glycol dioleate, wherein the functional fluid can achieve a Factory Mutual 6390 Group 1 or Group 2 rating.

2. The functional fluid according to claim 1, wherein the oxygen containing compound has a fire point according to ASTM D 92 of at least 250° C.

3. The functional fluid according to claim 1, wherein the alkyl(meth)acrylate polymers have a molecular weight in the range of 300 g/mol to 50 000 g/mol.

4. The functional fluid according to claim 1, wherein the alkyl(meth)acrylate polymers are obtainable by polymerizing a mixture comprising vinyl monomers containing aromatic groups.

5. The functional fluid according to claim 1, wherein the weight ratio of the alkyl(meth)acrylate polymers to the oxygen containing compound is in the range of 2:1 to 1:10.

6. The functional fluid according to claim 1, having a kinematic viscosity at 40° C. according to ASTM D 445 of from 28 $mm^2/s$ to 110 $mm^2/s$.

7. The functional fluid according to claim 1, having a pour point according to ASTM D 97 of −40° C. or less.

8. The functional fluid according to claim 1, having a fire point according to ASTM D 92 of at least 300° C.

9. The functional fluid according to claim 1, wherein the alkyl(meth)acrylate polymer comprises from 34 to 70 wt. % of methyl(meth)acrylate.

10. The functional fluid according to claim 9, wherein the alkyl(meth)acrylate polymer consists of monomers a), b), and c).

11. The functional fluid according to claim 1, wherein the alkyl(meth)acrylate polymer comprises copolymerized units of octadecenoic acid ester, lauryl methacrylate, and methyl methacrylate.

12. The functional fluid according to claim 1, wherein B) is present in an amount of 79.7 to 95% by weight based on the total weight of A) and B).

13. The functional fluid according to claim 1, consisting of A) and B).

14. The functional fluid according to claim 1, wherein the functional fluid has a Factory Mutual 6390 Group 1 rating.

15. The functional fluid according to claim 1, wherein the functional fluid consists of A) and B), the alkyl(meth)acrylate polymer comprises from 34 to 70 wt. % of methyl(meth) acrylate, and B) is present in an amount of 80 to 95% by weight based on the total weight of A) and B), and wherein the functional fluid has a Factory Mutual 6390 Group 1 rating.

16. The functional fluid according to claim 1, wherein the alkyl(meth)acrylate polymer comprises polymerized units of methyl(meth)acrylate.

17. The functional fluid according to claim 1, wherein R is methyl, $R^1$ is a methyl residue, and $R^2$ and $R^3$ represent hydrogen atoms in the ethylenically unsaturated ester compound of formula (I), and R is methyl, $R^5$ and $R^6$ are hydrogen atoms in the ethylenically unsaturated ester compound of formula (II).

18. The functional fluid according to claim 1, wherein the oxygen containing compound is at least one selected from the group consisting of neopentyl glycol dioleate, neopentyl glycol tallate, diethylene glycol dioleate, diethylene glycol tallate, propylene glycol tallate and propylene glycol dioleate.

19. The functional fluid according to claim 1, wherein the oxygen containing compound is neopentyl glycol dioleate.

20. A hydraulic oil comprising the functional fluid according to claim 1.

21. The hydraulic oil according to claim 20, wherein the hydraulic oil comprises at least 20% by weight of the functional fluid according to claim 1.

22. A method for improving the fire resistance of hydraulic fluids, transformer oils and quench oils, comprising:

mixing the functional fluid of claim 1 with the hydraulic fluid, transformer oil or quench oil.

23. The method according to claim 22, comprising:

mixing the functional fluid with an anhydrous hydraulic fluid.

24. A method for the manufacture of the functional fluid according to claim 1, wherein a mixture of olefinically unsaturated monomers is polymerized in a fluid of an oxygen containing compound according to component B).

* * * * *